United States Patent [19]

Sniffen et al.

[11] 4,197,138

[45] Apr. 8, 1980

[54] COMPOSITION AND METHOD FOR CLEANING PHOTOCOPY PLATEN OR MAT

[76] Inventors: John C. Sniffen, 217 Randolph St., Passaic, N.J. 07055; Geoffrey G. Smith, 10 Oak Tree La., Little Falls, N.J. 07424

[21] Appl. No.: 936,048

[22] Filed: Aug. 23, 1978

[51] Int. Cl.[2] ..... B08B 1/00

[52] U.S. Cl. ..... 134/6; 134/40; 252/91; 252/171; 252/172

[58] Field of Search ..... 134/6, 39, 40; 252/91, 252/162, 172, 364, 171

[56] References Cited

U.S. PATENT DOCUMENTS

| | | | |
|---|---|---|---|
| 2,076,604 | 4/1937 | Watson | 252/91 |
| 2,613,011 | 10/1952 | Smith | 252/91 UX |
| 3,751,970 | 8/1973 | Alburger | 252/162 X |
| 3,773,677 | 11/1973 | Boyles | 134/40 X |
| 3,937,665 | 2/1976 | Mammino et al. | 252/162 |

*Primary Examiner*—Marc L. Caroff

*Attorney, Agent, or Firm*—Ralph R. Roberts

[57] ABSTRACT

A cleaning fluid is used in a method for cleaning the white undersurface of a flexible or partly flexible mat cover of a photocopy machine. The cleaning fluid is essentially 1,1,1, trichloroethane to which a small amount of linseed oil is added to prevent evaporation and to provide a very thin coating of antistatic film to the cleaned surface of the mat. To this chemical cleaning agent a small amount of perfume or scent and a coloring agent are preferably added to make the chemical more appealing to the casual user. The mat is cleaned by scrubbing it with a coarse-faced pad or sponge impregnated with the cleaning fluid to remove accumulated dirt, oil, carbon inks and the like from the white undersurface.

12 Claims, 2 Drawing Figures

COMPOSITION AND METHOD FOR CLEANING PHOTOCOPY PLATEN OR MAT

BACKGROUND OF THE INVENTION

1. Field of the Invention

With the general classification of art as established by and in the U.S. Patent Office, this invention is found in the general class entitled, "Cleaning and Liquid Contact with Solids" (Class 134) and in the subclass entitled, "carbon removal" (subclass 39) and the subclass entitled, "oil, grease, tar or wax removal" (subclass 40).

2. Descriptio of the Prior Art

The chemical 1,1,1, trichloroethane is well-known and is mentioned in several U.S. Patents among which are: U.S. Pat. No. 2,838,458 as issued on June 10, 1958 to BACHTEL; U.S. Pat. No. 3,291,745 as issued on Dec. 13, 1966 to MARTENS; U.S. Pat. No. 3,293,312 as issued on Dec. 20, 1966 to RYCKAERT, et al.; U.S. Pat. No. 3,326,988 as issued on June 20, 1967 to STACK; U.S. Pat. No. 3,336,234 as issued on Aug. 15, 1967 to SPEIGHT; U.S. Pat No. 3,397,148 as issued on Aug. 13, 1968 to GRAMMER, et al.; U.S. Pat. No. 3,445,532 as issued May 20, 1969 to RICHTZENHAIN, et. al.; U.S. Pat. No. 3,501,538 as issued on Mar. 17, 1970 to ARCHER, et al.; U.S. Pat. No. 3,505,415 as issued on Apr. 7, 1970 to RICHTZENHAIN, et al. and U.S. Pat. No. 4,023,984 as issued on May 17, 1977 to CLEMENTSON, et al.

In these and other known uses of 1,1,1, trichloroethane its cleaning ability is well-known, particularly as a cleaning agent for clothing. As a dry cleaning agent and for other uses, where its inflammable qualities are desired, the chemical 1,1,1, trichloroethane is known. The inventors examined hundreds of mats for the purpose of discovering the amount and compositions of the dirt accumulation on the white undersurface of the mat. Conventional cleaners and several not so conventional cleaners were tried. Finally 1,1,1, trichloroethane was used and, although it loosened the accumulation of dirt, the rapid evaporation prevented proper cleaning. Evaporation of this chemical was slowed by the addition of kerosene, mineral spirits, motor oil, etc., but the residue left on the mat was unsatisfactory. A very small addition of linseed oil was found to provide the desired slowing of evaporation and was added to the chemical fluid and the residue was helpful for the use of the mat. Odor and color additives were also added to make the final product appealing to the user.

Packaging of the product was and is of major concern. Glass for a container and a screw cap to withstand the chemical can be provided but glass has a tendency to break. A jar of high density polyethylene is highly resistant to abuse and is satisfactory for containing the chemical. It is also less expensive than a glass jar. A spray container for this chemical mixture is not satisfactory because of rapid evaporation. A coarse scrubber unit is needed to catch and hold the loosened dirt particles to prevent smearing and reapplication of the dirt to the mat.

SUMMARY OF THE INVENTION

This invention may be summarized at least in part with reference to its objects.

It is an object of this invention to provide, and it does provide, a cleaner for a flexible mat of a photocopy machine whereby the white undersurface of the mat or platen is easily cleaned to bring it to new, or nearly new, white condition.

It is a further object of this invention to provide, and it does provide, a method of rapidly and easily removing dirt, oil, printing inks, carbon inks and like material which accumulate on the undersurface of a mat used to cover the copy and glass of a photocopy machine.

It is to also be noted that the smallest size copy on most photocopy machines is $5\frac{1}{2}\times8\frac{1}{2}$ inches (139.7×215.9 mm.) The copying of a post card, business card, etc. by the camera lens, in addition to the card, also causes a picture of the mat to be taken. A "dirty" mat causes a dark picture and a "dirty" copy. For filing purposes and uniformity many offices copy an original that is smaller than standard office size, $8\frac{1}{2}\times11$ inches (215.9×279.4 mm) on this standard size sheet and the background mat is reproduced.

The cleaning material used in this invention is essentially 1,1,1, trichloroethane, a well-known chemical. Evaporation of this chemical is very rapid and prevents proper cleaning of the mat surface. The addition of linseed oil slows the evaporation of this chemical and leaves a very thin antistatic film on the cleaned mat. A combination of linseed oil, one part to twenty parts of 1,1,1, trichloroethane chemical, produces a very satisfactory mixture. Pine oil scent at a ratio of one part of forty parts chemical mixture is also added to make the odor of the pads and the fingers of the user more agreeable. To alter the unappealing color of the fluid cleaner a minute amount of dye is added. At present, blue dye is added until a light green color of the fluid cleaner is obtained.

In brief, the present invention provides a cleaning fluid whose essential component is 1,1,1, trichloroethane having about a one-twentieth additive of linseed oil for inhibiting evaporation. A mild scent and color additive may be provided to make the fluid of the cleaner product more attractive to the user. A scrubbing pad having a coarse surface and absorbent ability is used with this chemical so that as and after the deposited soil on the pad is broken down and loosened this soil is deposited on and absorbed into the pad.

The heat from a quartzline or halogen high intensity lamp tends to bake the dirt on the platen or mat. A replacement mat is costly whereas with the cleaner product and method, to be hereinafter more fully described, the original mat is once again brought to a new or nearly new condition with a white reflective surface. This improves copy quality and reduces the toner needed to make a clear and satisfactory copy. A clean mat improves the copy since the camera reproduces exactly what it "sees". The camera also "sees" a dirty mat and a dirty, smudged, indistinct copy results.

In addition to the above summary, the following disclosure is detailed to insure adequacy and aid in understanding of the invention. This disclosure, however, is not intended to cover each new inventive concept therein no matter how it may later be disguised by variations in form or additions of further improvements. For this reason there has been chosen a specific embodiment of the platen or mat cleaning fluid and a container for the shipping and storage of this chemical as adopted for use with the scrubber cleaning pad and showing a preferred method for restoring flexible mats of photocopy machines to new or nearly new condition. This specific embodiment has been chosen for the purposes of illustration and description as shown in the accompanying drawing wherein:

DESCRIPTION OF THE PREFERRED EMBODIMENT

Figure 1:
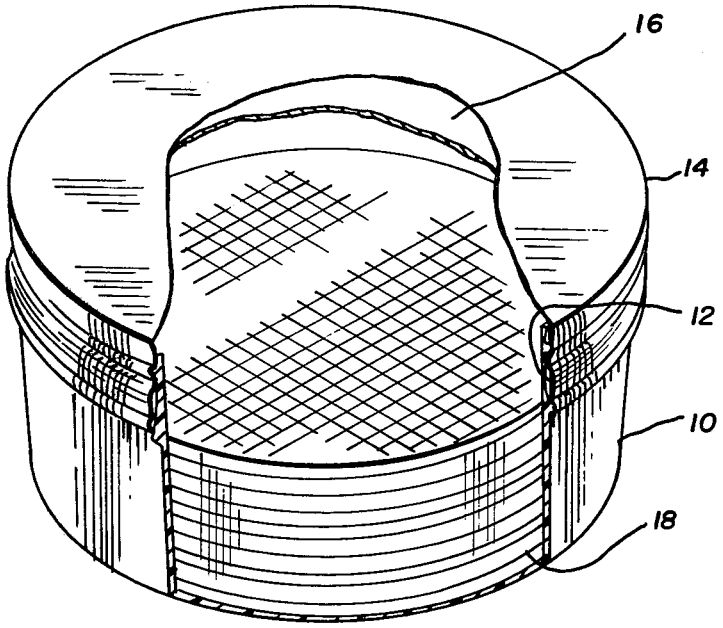
FIG. 1 represents an isometric side view, partly in section, and showing the product as packaged for shipment and/or storage prior to use.

Referring now to the drawing and in particular to FIG. 1, there is depicted a jar 10, which for shipping and storage purposes is made preferably of plastic, such as high density polyethylene. Such a jar is capable of storing the cleaner product without deterioration or deformation of the jar and also has a high resistance to breaking. Glass can, of course, be used but is more likely to break. This depicted jar has a large open mouth or top which conventionally has a thread 12 formed therearound.

A cap or cover 14 is preferably made of metal such as steel or aluminum. For appearance both the outside and inside of the cap are painted, but protection of this metal cap from corrosion attack by the chemicals in the cleaner is conventionally provided by a cardboard insert and seal 16. Preferably this insert 16 has a polyethylene coated face or surface, but other impervious liners can be used, such as Teflon (TM DuPont) or some sheet metals such as tin plate. This cap can also be molded of plastic to provide a suitable seal of the contents of the jar 10.

A stack of scrubbing pads 18 of generally circular configuration are shown as packaged with and in the jar or container 10. These pads are preferably of synthetic material such as crosshatched woven rayon. Each pad is preferably a sandwich having a center of a polyurethane foam. A glue which is a urethane adhesive holds this sandwich pad together for use and storage. A solution of cleaning fluid is placed in the jar and saturates those pads which are placed in and then sealed in the jar.

Figure 2:
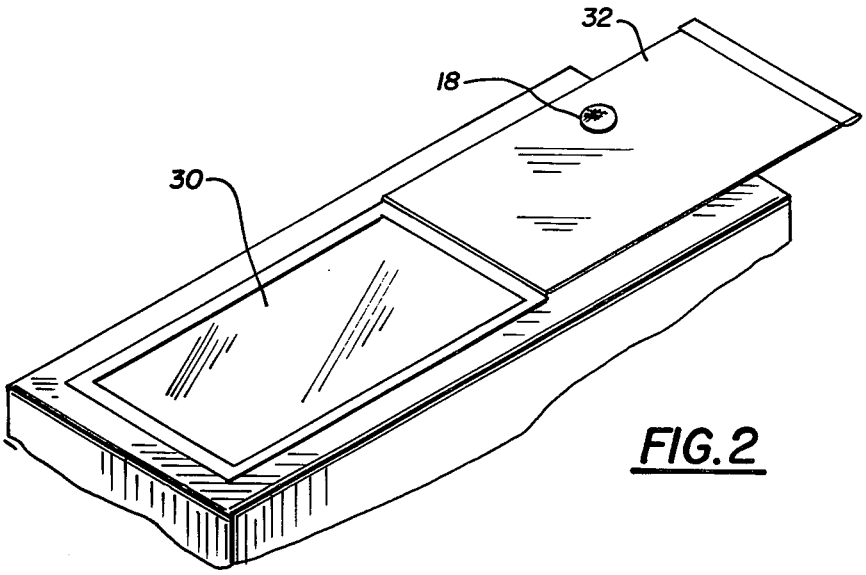
FIG. 2 represents an isometric view showing a representation of a typical photocopy machine with its protective flexible cover moved to an open condition whereat a treated pad is applied to the undersurface to remove dirt and grease from the flexible mat or platen of this photocopy machine.

Use of the Cleaner Pad as in FIG. 2

Referring next and finally to FIG. 2, there is represented a photocopy machine of conventional construction which utilizes a top glass 30 upon which the copy to be reproduced is placed face down. A flexible cover 32 is then brought above and is laid on the copy so as to cover the copy and glass. A frame 34 for and of the photocopy apparatus is also depicted. A pad 18 is removed from the jar 10 and, to prevent unwanted evaporation, the cap or cover 14 is replaced on the jar. The removed pad 18 is rubbed briskly and firmly over the undersurface of this mat cover 32 and most of the stains, dirt and oil from the skin or fingers of the operator are removed from the mat surface. Also softened and removed are printing inks, carbon from carbon copies and typewriter inks that tend to build up on the mat.

This flexible mat 32 covers the copy and glass 30 while the machine makes the reproduction. The rays from a high intensity lamp or lamps (700 to 1,000 watts) are blocked by this mat so that these rays do not adversely affect the eyes of the user. Without a mat a black copy results. Cleaning of the mat undersurface restores the mat to or near its original whiteness and improves copy quality. In particular, where paper such as onion skin, vellum etc. are to be copied, a dirty mat results in a "dirty" reproduction of the original, i.e. a dirty mat will result in the copy being smudged and background dirt reproduced since the photocopy machine camera lens photographs exactly what it "sees".

As far as is known, the mats of copy machines have not been satisfactorily cleaned with commercial cleaners. The servicing of photocopy machines has brought numerous requests and inquiries from office personnel as to how and what will satisfactorily clean the mat of a photocopy machine. In the present invention the scrubber pads are impregnated with the identified cleaner fluid and as the cleaner loosens the stains, dirt, oils, inks, etc. the pad 18 and the towel surface thereof catches and holds the loosened dirt particles and thereby prevents smearing and reapplication of the dirt. A plain sponge of plastic or rubber may be used, but provides no superiority and is usually more costly than the pads above-described. The above chemical and pad lends itself to a method for cleaning a mat of a photocopy machine in which the light or undersurface of a mat or platen of a photocopy machine is scrubbed to remove an accumulation of printing inks, stains, dirt, grease, oils from the skin, carbon paper, carbon inks and the like that tend to build-up on the undersurface of the mat, this method including the steps of: removing a chemically treated and saturated pad from a storage container; scrubbing the undersurface of the mat of the photocopy machine with a moistened pad to loosen the dirt on said surface and to clean this surface with the removed dirt being collected by and on this pad, and allowing the surface of the mat to dry with an antistatic film, the chemical composition being of essentially 1,1,1, trichloroethane and having mixed therewith a small portion of linseed oil. This chemical being stored in an impervious container and used with scrubbing pads having a coarse surface.

The undersurface of the mat or platen of a photocopy machine is cleaned by using a chemical composition consisting essentially of 1,1,1, trichloroethane of not less than ninety percent and a small portion of linseed oil in a ratio of at least 1 part to 30 parts of the 1,1,1, trichloroethane and not more than 1 part to 10 parts of the 1,1,1, trichloroethane.

This linseed oil added to the 1,1,1, trichloroethane to provide a necessary and desired evaporation inhibitator and to leave a residual antistatic film on said cleaned mat surface. Preferable the chemical compound also contains a small amount of aromatic scent and a color addative of not more than five percent.

Terms such as "up", "down", "bottom", "top", "in", "out", and the like are applicable to the embodiment shown and described in conjunction with the drawing. These terms are merely for the purposes of description and do not necessarily apply to the position in which the container, pads and the chemical compound may be constructed or used.

While a particular embodiment of the platen or mat cleaner has been shown and described it is to be understood the invention is not limited thereto since modifications may be made within the scope of the accompanying claims and protection is sought to the broadest extent the prior art allows.

What is claimed is:

1. Product for cleaning the light or white undersurfaces of a mat or platen of a photocopy machine to remove an accumulation of printing inks, stains, dirt, grease and oils from the skin, carbon paper, carbon inks and like material that tend to build up on this undersurface, including: (a) a chemical composition consisting essentially of at least ninety percent of 1,1,1, trichloroethane a small portion of linseed oil in a ratio of at least 1 part to 30 parts of the 1,1,1, trichloroethane and not more than 1 part to 10 parts of the 1,1,1, trichloroethane to inhibit evaporation of the 1,1,1, trichloroethane and so as to leave a residual antistatic film of linseed oil on said mat; (b) a container retaining said composition that is impervious to the chemical cleaner composition and providing means for the selective withdrawal from the container of this mixed composition said container having a sufficiently wide mouth to provide easy withdrawal of a portion of the contents of said container: (c) a cover for the container providing means for opening and closing the container for removable mounting on the container before withdrawal of said contents and then for closing said container to prevent unwanted evaporation of the chemical composition, and (d) a plurality of scrubbing pads stored within the container which may be withdrawn from the container one-at-a-time upon removal of the cover, each scrubbing pad being saturated with said composition and having a coarse surface to assist in moving and removing the chemically loosened dirt from the surface of said mat, the pads also having sufficient absorbing ability to lift and retain the loosened dirt without smearing and redepositing the dirt on the mat.

2. Product for cleaning mats as in claim 1 in which the chemical composition in the container is essentially 1,1,1, trichloroethane of at least 90 parts with the remainder being linseed oil at least 5 parts and the balance being an aromatic scent and a color additive.

3. Product for cleaning mats as in claim 1 wherein said container is composed of glass.

4. Product for cleaning mats as in claim 1 wherein said container is composed of high density polyethylene.

5. Product for cleaning mats, as in claim 3 or 4, in which the container cover is a screw on closure having a liner protector which is impervious to the chemical composition in the container.

6. Product for cleaning mats as in claim 1 in which the pad is made of a crosshatch woven synthetic material such as rayon.

7. Product for cleaning mats as in claim 6 in which the pad is a sandwich held together by a fully cross linked urethane adhesive.

8. Product for cleaning mats as in claim 7 in which polyurathane foam is placed between outer sandwich facings of coarse woven synthetic material.

9. A chemical composition for cleaning the light or white undersurface of a mat of a photocopy machine to remove an accumulation of printing inks, stains, dirt, grease, oils from the skin, carbon paper, carbon inks and the like that tend to build up on the undersurface of the mat; this composition consisting essentially of at least ninety percent of 1,1,1, trichloroethane and a small portion of linseed oil in a ratio of at least 1 part to 30 parts of the 1,1,1, trichloroethane and not more than 1 part to 10 parts of the 1,1,1, trichloroethane to provide evaporation inhibition and with this linseed oil providing a residual antistatic film on the cleaned mat after evaporation of the chemical composition.

10. A chemical composition for cleaning mats as in claim 9 in which the chemical composition also includes a small amount of aromatic scent and a color additive is provided which does not exceed more than five percent of the chemical composition.

11. A method for cleaning the light or undersurface of a mat of a photocopy machine with the product of claim 1 to remove an accumulation of printing inks, stains, dirt, grease, oils from the skin, carbon paper, carbon inks and the like that tend to build up on the undersurface of the mat, this method including the steps of: (a) removing a pad saturated with said chemical composition from said storage container; (b) scrubbing the undersurface of the mat of the photocopy machine with the chemically moistened pad to loosen the dirt on said surface and to clean this surface with the removed dirt being collected by and on this pad, and (c) allowing the surface of the mat to dry with an antistatic film.

12. The method for cleaning a mat as in claim 11 in which an aromatic scent and color are added to the 1,1,1, trichloroethane and linseed oil, this scent and color in a not greater ratio than one to twenty.

* * * * *